US006451130B1

(12) United States Patent
Chung et al.

(10) Patent No.: US 6,451,130 B1
(45) Date of Patent: Sep. 17, 2002

(54) METHOD FOR FORMING $CR_2O_3$ FILM ON STAINLESS STEEL SURFACE

(75) Inventors: Suk-min Chung; Bok-lae Cho, both of Pohang (KR)

(73) Assignee: Pohang University of Science and Technology Foundation, Kyungsangbuk-do (KR)

( * ) Notice: Subject to any disclaimer, the term of this patent is extended or adjusted under 35 U.S.C. 154(b) by 9 days.

(21) Appl. No.: 09/606,193

(22) Filed: Jun. 29, 2000

(30) Foreign Application Priority Data

Dec. 23, 1999 (KR) ..... 99-61329

(51) Int. Cl.[7] ..... C23C 8/10
(52) U.S. Cl. ..... 148/286; 148/270; 148/264
(58) Field of Search ..... 148/269, 270, 148/286; 428/472.1

(56) References Cited

U.S. PATENT DOCUMENTS 5,456,768 A * 10/1995 Tomari et al. ..... 148/280

OTHER PUBLICATIONS

Chun et al., "Effect of the Cr–rich oxide furnace on fast pumpdown to ultrahigh vacuum", American Vacuum Society, published Oct. 1997, pp. 2518–2520.*

Cho et al; "A novel $Cr_2O_3$ thin film on stainless steel with high sorption resistance", *Surface Science*, vol. 439, pp. L799–L802, Sep. 1999.

* cited by examiner

*Primary Examiner*—John Sheehan
*Assistant Examiner*—Andrew L. Oltmans
(74) *Attorney, Agent, or Firm*—Leydig, Voit & Mayer, Ltd.

(57) ABSTRACT

A method for forming a chromium oxide film on the surface of a stainless steel sample. The method includes: (a) placing a sample having stainless a steel surface into a vacuum furnace, evacuating the vacuum furnace to a pressure of $2\times10^{-7}$ to $3\times10^{-7}$ Torr, and heating the vacuum furnace to 450 to 600° C. at a rate of 5 to 10° C./min; (b) maintaining the vacuum furnace for 10 to 20 minutes at a temperature of 450 to 600° C. to remove foreign materials from the surface of the stainless steel sample and to extract chromium atoms from the stainless steel substrate; and (c) supplying oxygen to the vacuum furnace while maintaining the temperature until oxygen partial pressure reaches $1\times10^{-9}$ to $2.5\times10^{-7}$ Torr, so the extracted chromium atoms react with oxygen, producing a chromium oxide ($Cr_2O_3$) film on the surface of the stainless steel. The dense and smooth $Cr_2O_3$ film improves oxidation resistance and sorption resistance, and suppresses diffusion and permeation of hydrogen.

3 Claims, 3 Drawing Sheets

METHOD FOR FORMING $CR_2O_3$ FILM ON STAINLESS STEEL SURFACE

BACKGROUND OF THE INVENTION

1. Field of the Invention

The present invention relates to a method for forming a chromium oxide film on the surface of stainless steel, and, more particularly, to a method for forming a chromium oxide film, as a passivation layer, on a stainless-steel surface, by which oxidation resistance is markedly increased with reduced moisture adsorption, and diffusion and permeation of hydrogen into the stainless steel can be sharply prevented.

2. Description of the Related Art

The definition of the terms "clean surface" in the vacuum related fields varies according to vacuum exposure environments. In other words, "clean" means much more than scrubbing the sample and handling it with care. For example, in an ultra high vacuum of $1\times10^{-9}$ Torr or an extreme high vacuum of $1\times10^{-12}$ Torr, a "clean surface" is defined as a surface at which outgassing due to thermal effects does not occur beyond a particular level. For the reduction of outgassing, any ultra high vacuum chamber and the compartments thereof must be subjected to pretreatment, such as chemical cleaning or electrolytic polishing.

Stainless steels are the preferred materials for ultra high vacuum or extreme high vacuum processing conditions because of their superior oxidation resistance, low outgassing rate, and easy welding properties.

Stainless steels have a native passivation oxide layer. Although the surface of stainless steel is protected by the native passivation oxide layer, it still has a strong affinity for gases, so that when exposed to air, the surface is prone to absorb gases such as water vapor. Water molecules are adsorbed onto the surface or into the near surface region of stainless steel, and the porous surface oxide layer serves as a reservoir for water. This weakness of stainless steel against moisture sorption and subsequent outgassing has been a problem in unbaked stainless steel vacuum systems.

The conventional surface treatment technique can create an ultra high vacuum condition to a certain extent. However, since the hydrophilic porous surface absorbs excess water, it takes a long time to evacuate the chamber and the degree of vacuum is also lowered.

SUMMARY OF THE INVENTION

To solve the above problems, it is an objective of the present invention to provide a method for processing the surface of stainless steel, by which moisture sorption, and diffusion and permeation of hydrogen can be suppressed, so that evacuation time can be sharply reduced with an improved degree of vacuum.

To achieve the above objective of the present invention, there is provided a method for forming a chromium oxide film on a stainless steel surface, comprising: (a) placing a sample having the stainless steel surface into a vacuum furnace, evacuating the vacuum furnace to a pressure of $2\times10^{-7}$ to $3\times10^{-7}$ Torr, and heating the vacuum furnace to 450 to 600° C. at a rate of 5 to 10° C./min; (b) maintaining the pressure in the vacuum furnace for 10 to 20 minutes at a temperature of 450 to 600° C. to remove foreign materials from the surface of the stainless steel and to diffuse chromium atoms from the interior of the stainless steel; and (c) supplying oxygen into the vacuum furnace while maintaining the pressure and temperature until an oxygen partial pressure reaches $1\times10^{-9}$ to $2.5\times10^{-7}$ Torr, to cause the diffused chromium atoms to react with oxygen, resulting in the chromium oxide ($Cr_2O_3$) film on the surface of the stainless steel.

Preferably, step (c) is carried out for 50 seconds to 28 hours.

Preferably, when the temperature of the vacuum furnace is 450° C., step (c) is carried out at a pressure of $1\times10^{-9}$ to $2\times10^{-9}$ Torr for 14 to 28 hours.

Preferably, when the temperature of the vacuum furnace is 500° C., step (c) is carried out at a pressure of $8\times10^{-9}$ to $9\times10^{-9}$ Torr for 3 to 3.5 hours.

Preferably, when the temperature of the vacuum furnace is 550° C., step (c) is carried out at a pressure of $5\times10^{-8}$ to $6\times10^{-8}$ Torr for 1,600 to 2,000 seconds. Preferably, when the temperature of the vacuum furnace is 600° C., step (c) is carried out at a pressure of $2.5\times10^{-7}$ to $3.5\times10^{-7}$ Torr for 300 to 400 seconds.

Preferably, the stainless steel includes 304, 304L, 316, 316L and 316LN stainless steels.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1A:
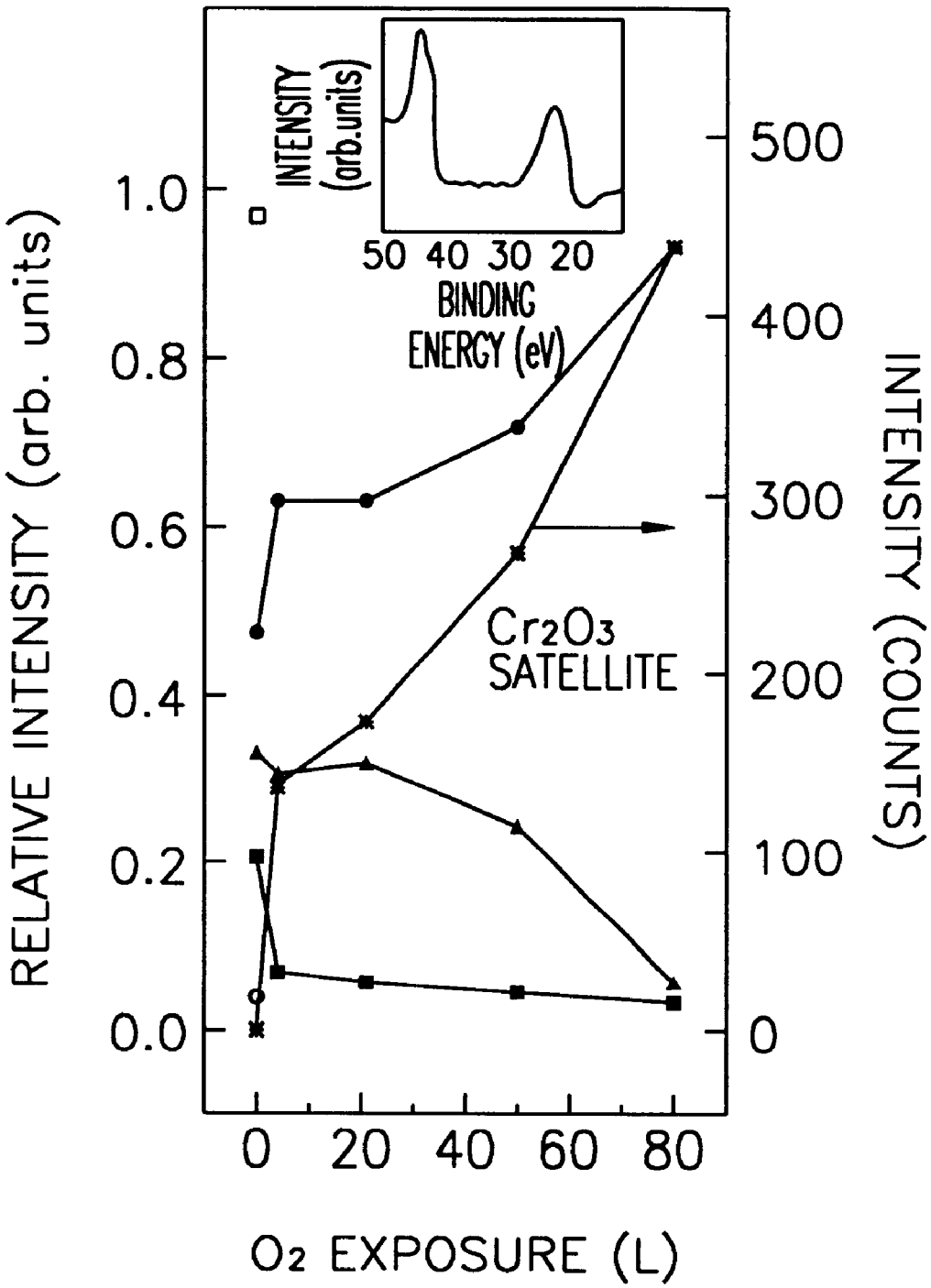
FIGS. 1A and 1B are graphs illustrating changes of the surface composition of a 304 stainless steel surface at partial pressures of $1\times10^{-9}$ and $1\times10^{-7}$ Torr of oxygen.

A method for processing the surface of stainless steel according to the present invention wherein a stainless steel sample is heated at an appropriate temperature at an appropriate oxygen partial pressure in a high vacuum environment such that chromium (Cr) comes out of the surface of the stainless steel from the inside, which allows a chemical reaction with oxygen.

The novel feature of the present invention is based on the fact that a chromium oxide film formed on the stainless steel surface has a hydrophobic property. In other words, if the porous oxide film on the stainless steel surface is replaced with a dense chromium oxide film, the outgassing from the stainless steel surface can be greatly reduced.

The formation of the chromium oxide film may be carried out by a vacuum thermal oxidation method (G. Hultquist, C. Leygraf, *Mater. Sci. Eng.*, 42(1980), p. 99). The chromium oxide film on the stainless steel surface serves as a diffusion barrier for hydrogen, reduces surface roughness, and causes a sharp reduction in outgassing at ambient conditions.

To create a chromium oxide film with a smooth surface, the present inventors slowed down the growth rate of the oxide film. Also, formation of the perfect chromium oxide film was evidenced using surface-sensitive synchrotron radiation photoemission and temperature programmed desorption (TPD) techniques. As a result, it has been shown that the oxide film present on the surface is almost pure $Cr_2O_3$. Also, it was found that the formed $Cr_2O_3$ thin film shows a marked sorption resistance.

When the inventive method is applied to the manufacture of a vacuum furnace, moisture sorption in the vacuum furnace can be sharply lowered, which allows the vacuum level of the chamber to reach ultra high vacuum after preventilation. In addition, the thin film formed on the stainless steel surface, which acts as a barrier, suppresses the diffusion and permeation of hydrogen, and thus extreme high vacuum as well as ultra high vacuum can be easily attained.

Hereinafter, a method for forming a chromium oxide film on the surface of a stainless steel according to the present invention will be described in greater detail with reference to the appended drawings.

The surface processing on the stainless steel sample according to the present invention is preferably performed at the final step in the manufacture of a stainless steel vacuum furnace. First, the components which will constitute the vacuum furnace are placed into a vacuum furnace and then evacuated to a pressure of $2\times10^{-7}$ to $3\times10^{-7}$ Torr or less.

Then, the temperature of the vacuum furnace is raised slowly to 450° C. at a rate of 5° C./min, and heated at this temperature for 10 to 20 minutes to remove foreign materials from the surface of the stainless steel sample and to simultaneously diffuse chromium from the stainless steel substrate. While keeping the temperature of the chamber at the same level, oxygen is allowed to flow into the vacuum furnace until the partial pressure of oxygen reaches about $1\times10^{-9}$ Torr, which allows a chemical reaction between the diffused chromium and the supplied oxygen, so that a chromium oxide film is formed on the surface of the stainless steel substrate.

In the formation of the chromium oxide film, the partial pressure and the reaction temperature are correlated. For example, the pressure in the vacuum furnace is maintained at $8\times10^{-9}$ Torr for a temperature of 500° C., at $5\times10^{-8}$ Torr for 550° C., and at $2.5\times10^{-7}$ Torr for 600° C. After the formation of the oxide film is completed, the heater of the vacuum furnace is turned off and then cooled slowly to room temperature.

The stainless steel substrate formed by the inventive method has a smooth, dense and thin chromium oxide film over its surface, so that the moisture sorption rate sharply drops to 1/100 or less. Also, the diffusion and permeation of hydrogen is prevented, so that the vacuum furnace can reach a desired vacuum level within a short period of time with an improved degree of vacuum.

It is assumed that a turbo-molecular pump is used for evacuating the vacuum furnace. For a vacuum furnace manufactured by a conventional method, the pressure of the vacuum furnace remains near $1\times10^{-8}$ Torr. Meanwhile, the stainless steel vacuum furnace processed by the inventive method can reach $1\times10^{-10}$ Torr, which is 100 times lower than the vacuum level of the conventional vacuum furnace, within merely 5 hours. In addition, while the pressure of the conventional vacuum furnace reaches $2\times10^{-10}$ Torr at the lowest, the pressure of the vacuum furnace manufactured by the inventive method can drop to $1\times10^{-11}$ Torr or less, which is close to the extreme high vacuum region.

The present invention will be described in greater detail by means of the following examples. The following examples are for illustrative purposes and not intended to limit the scope of the invention.

In the present embodiment, commercial-grade 304-stainless steel foil was used as a sample. Photoemission measurements were performed at the 2B1 spherical grating monochromator beamline at the Pohang light Source (PLS) in the Pohang Accelerator Laboratory. The overall instrument resolution was about 0.4 eV at a photon energy hv=143 eV, which was chosen to measure the surface-sensitive Cr 3p and Fe 3p spectra. During the measurements, the base pressure was maintained at $1\times10^{-10}$ Torr or more, and the oxidation temperature was maintained at 450° C.

Figure 1B:
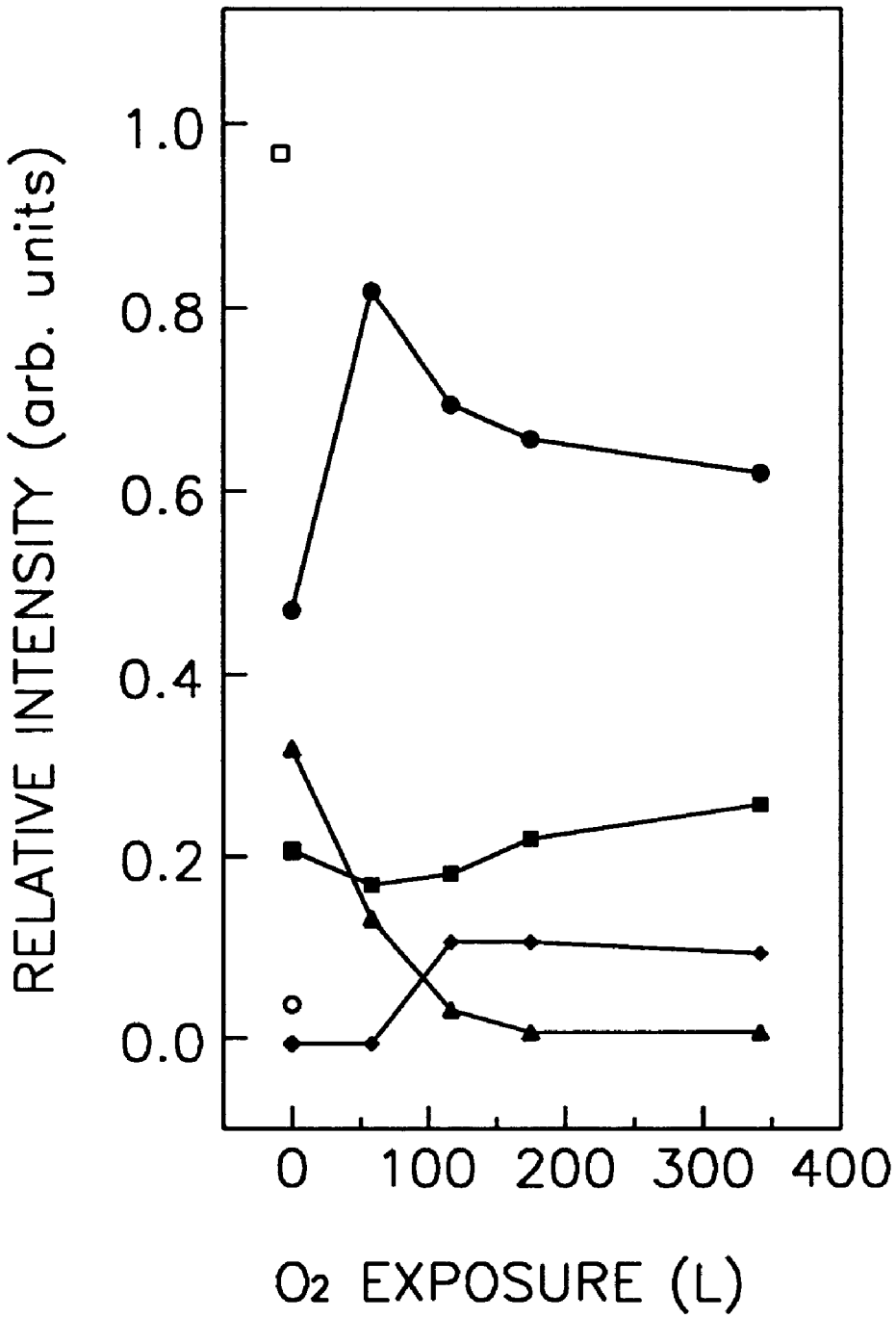

FIGS. 1A and 1B show the changes of the surface composition of the 304 stainless steel at 450° C. exposed to oxygen partial pressures of $1\times10^{-9}$ and $1\times10^{-7}$ Torr, respectively. In FIGS. 1A and FIG. 1B, the relative amounts of trivalent Cr (•), metallic Cr (▲), hexavalent Cr (◆), and iron (■) are plotted. Also, the intensity of the $Cr_2O_3$ satellite peaks (*) is also shown in FIG. 1A. Also, the inset in FIG. 1A shows the wide-scan photoemission spectrum at an oxygen exposure of 3.6L.

Referring to FIGS. 1A and 1B, the plots show that an iron oxide film is replaced by a chromium oxide film. The chromium oxide is then easily characterized by photoemission spectra. In effect, the chromium is mostly in the form $Cr_2O_3$, as evidenced by the binding energy, spin-orbit and multiplet splittings of the Cr 3p as well as its satellite feature at 13 eV binding energy.

Referring to FIG. 1A, as the oxygen exposure increases, the trivalent Cr concentration continues to increase, whereas the metallic Cr and trace iron oxides steadily decrease. At above 100L, there will remain only a chromium-oxide film that has a stoichiometry of $Cr_2O_3$. The thickness of the $Cr_2O_3$ film, deduced from photonenergy dependence studies, appears to be ~10A. This thickness corresponds to about 1.5λ, where λ is the electron escape depth (λ≈6A). No measurable chromium-depleted zone was found.

By contrast, the plots in FIG. 1B, which were measured at an oxygen partial pressure of $1\times10^{-7}$ Torr, show that an initial increase (decrease) in the surface chromium (iron) content is followed by a steady decrease (increase) with an increase in oxygen exposure. Here, the critical pressure $p_c$ is defined as the oxygen pressure at which the supply of oxygen starts to exceed the volume diffusion of Cr. The critical pressure $p_c$ at 450° C. is about $1\times10^{-8}$ Torr. If the oxygen partial pressure is higher than the critical pressure $p_c$, for example, at $1\times10^{-7}$ Torr, the amount of Cr atoms diffusing to the surface is limited and prevents all oxygen from reacting only with Cr. Thus, iron segregates there during further oxidation, and the film becomes more enriched in iron. Meanwhile, at an oxygen partial pressure of $1\times10^{-9}$ Torr, there is a larger supply of Cr than of oxygen, and thus a pure $Cr_2O_3$ film is developed.

Figure 2:
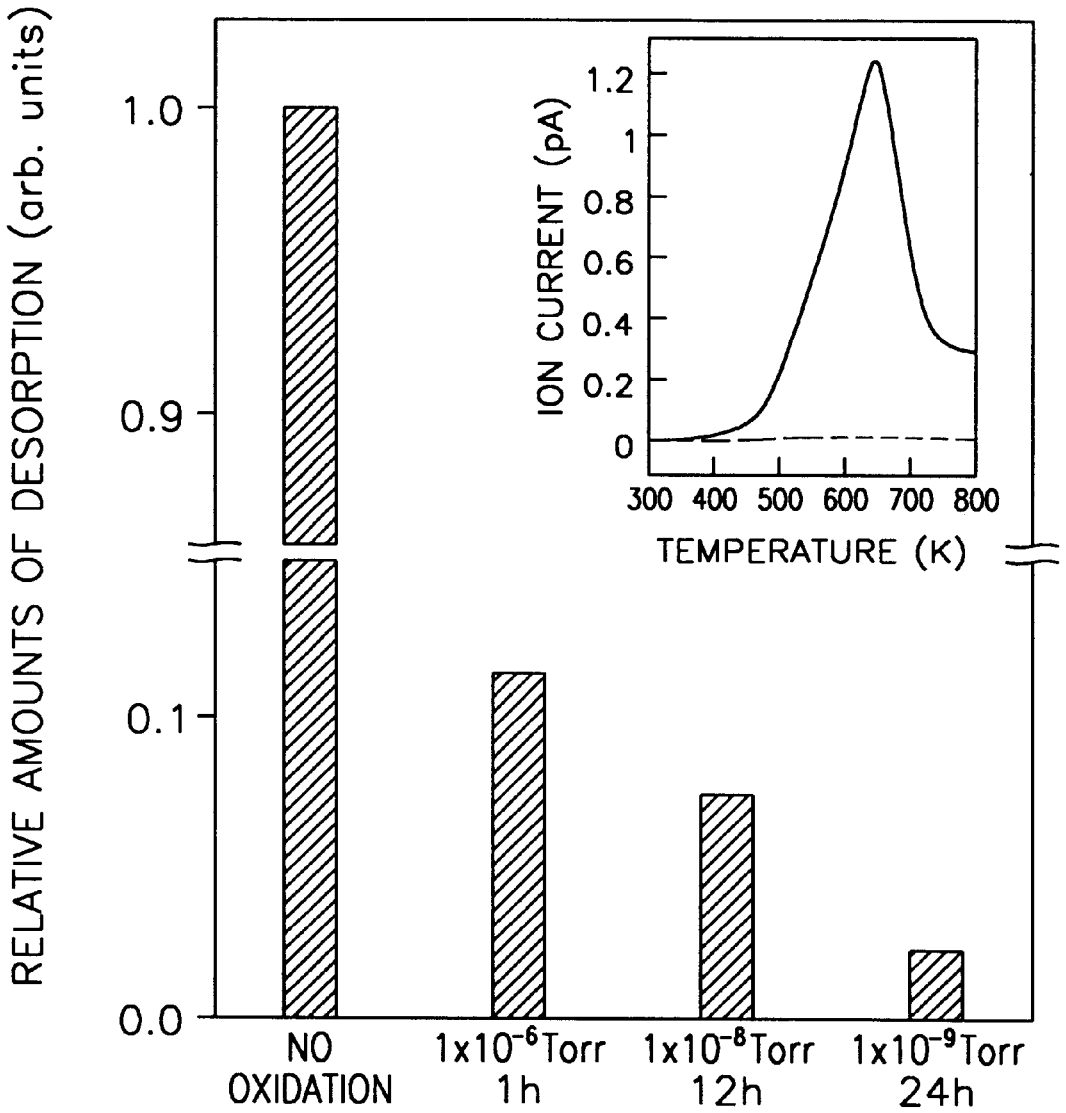
FIG. 2 is a graph showing relative amounts of water per unit area desorbed from the unoxidized and oxidized surfaces of 304 stainless steel.

The thermal desorption characteristics of the, thin $Cr_2O_3$ film surface were investigated by TPD. For comparison, the venting condition was kept the same by using an extremely dry nitrogen venting system. FIG. 2 shows the relative amounts of water per unit area desorbed from the unoxidized and oxidized surfaces of the 304 stainless steel surface at 450° C. at three oxygen partial pressures, namely, at $1\times10^{-4}$ Torr for 1 hour, at $1\times10^{-8}$ Torr for 12 hours and at $1\times10^{-9}$ Torr for 24 hours. The surface oxidation, even at $1\times10^{-4}$ Torr, which is much higher than the critical pressure $p_c$, greatly reduces the quantity of $H_2O$ released. At an oxygen partial pressure of $1\times10^{-9}$ Torr, which is lower than the critical pressure $p_c$, the amount of water desorbed from the oxidized stainless steel surface is three times lower than that at $1\times10^{-6}$ Torr. As a result, the total amount of $H_2O$ desorbed from the $Cr_2O_3$ film surface is about two times smaller than that from the unoxidized surface.

The inset in FIG. 2 shows thermal desorption spectra of water for the unoxidized surface (solid line) and the oxidized surface at $1\times10^{-9}$ Torr (dotted line). As shown in the TPD spectra of $H_2O$, the unoxidized surface shows a large peak around 650 K, whereas a distinct peak is not detected from the $Cr_2O_3$ (oxidized at $1\times10^{-9}$ Torr for 24 hours) over the temperature range. This result indicates that there is a remarkable improvement in terms of sorption-resistant properties.

The outgassing rate of an oxidized extreme high vacuum furnace is about 100 times lower than that of an unoxidized ultra high vacuum furnace. This superior adsorption resistance of the oxidized stainless steel surface in such a high vacuum condition is regarded as a result of the compact rhombohedral structure of the $Cr_2O_3$ film. Also, the extremely smooth surface of the $Cr_2O_3$ film contributes to reducing the adsorption of water. In other words, the sorption resistance of the stainless steel is enhanced by forming the smooth and dense $Cr_2O_3$ film.

As described above, the method for processing the surface of a stainless steel substrate according to the present invention provides a dense and smooth $Cr_2O_3$ film to the surface, which sharply suppresses the adsorption of moisture and the diffusion and transmission of hydrogen. Thus, the degree of vacuum can be raised to a higher level, for example, to the extreme high vacuum level of $1\times10^{-11}$ Torr or less, and the time required for reaching a desired vacuum level can be reduced. Furthermore, the formation of the new $Cr_2O_3$ film on the stainless steel surface according to the present invention can provide ultra high or extreme high vacuum with excellent cleanliness and superior performance. The stainless steel surface processing technique according to the present invention is applicable in fabricating more advanced semiconductor devices, which need an extreme high vacuum environment.

While this invention has been particularly shown and described with reference to preferred embodiments thereof, it will be understood by those skilled in the art that various changes in form and details may be made thereto without departing from the spirit and scope of the invention as defined by the appended claims.

What is claimed is:

1. A method for forming a chromium oxide film on a stainless steel surface, comprising:

(a) placing a sample having a stainless steel surface into a vacuum furnace, evacuating the vacuum furnace to a pressure of $2\times10^{-7}$ to $3\times10^{-7}$ Torr, and heating the vacuum furnace to 450 to 600° C. at a rate of 5 to 10° C./min;

(b) maintaining the pressure in the vacuum furnace for 10 to 20 minutes at a temperature of 450 to 600° C. to remove foreign materials from the surface of the stainless steel sample and to diffuse chromium atoms from the interior of the stainless steel; and (c) supplying oxygen to the vacuum furnace while maintaining the pressure and temperature until oxygen partial pressure reaches $1\times10^{-9}$ to $2.5\times10^{-7}$ Torr, so the chromium atoms diffused react with the oxygen, producing a chromium oxide ($Cr_2O_3$) film on the stainless steel surface.

2. The method of claim 1, wherein step (c) is carried out for 300 seconds to 28 hours.

3. The method of claim 1, wherein the stainless steel is selected from the group consisting of 304, 304L, 316, 316L and 316LN stainless steels.

* * * * *